US009928815B2

(12) United States Patent
Sikra

(10) Patent No.: US 9,928,815 B2
(45) Date of Patent: Mar. 27, 2018

(54) DRUM PEDAL WITH INTERLOCKING FEATURES

(71) Applicant: Drum Workshop, Inc., Oxnard, CA (US)

(72) Inventor: Richard A. Sikra, Thousand Oaks, CA (US)

(73) Assignee: DRUM WORKSHOP, INC., Oxnard, CA (US)

( * ) Notice: Subject to any disclaimer, the term of this patent is extended or adjusted under 35 U.S.C. 154(b) by 0 days.

(21) Appl. No.: 15/263,881

(22) Filed: Sep. 13, 2016

(65) Prior Publication Data

US 2016/0379609 A1 Dec. 29, 2016

Related U.S. Application Data

(60) Continuation of application No. 15/072,924, filed on Mar. 17, 2016, now Pat. No. 9,472,174, which is a division of application No. 14/495,718, filed on Sep. 24, 2014, now Pat. No. 9,589,546, application No. 15/263,881, which is a division of application No. 14/495,718.

(60) Provisional application No. 61/899,762, filed on Nov. 4, 2013, provisional application No. 61/882,538, filed on Sep. 25, 2013.

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
CPC ..... G10D 13/006
See application file for complete search history.

(56) References Cited

U.S. PATENT DOCUMENTS 1,042,919 A * 10/1912 Hughes ..... G10D 13/006 84/422.2
3,797,356 A 3/1974 Duffy et al.
4,235,146 A * 11/1980 Purdy ..... G10D 13/006 84/225
4,756,224 A * 7/1988 Lombardi ..... G10D 13/006 84/422.1
5,301,592 A 4/1994 Johnston
(Continued)

OTHER PUBLICATIONS

DW Drums. DW 9000 Pedal Upgrades—Artist Testimonials. Youtube: Video (online). Nov. 5, 2012 (retrieved Mar. 15, 2017). Retrieved from the Internet: https://www.youtube.com/watch?v=B9zKsz93PVk>; 6 : 0093 : 13.
(Continued)

*Primary Examiner* — Robert W Horn
(74) *Attorney, Agent, or Firm* — Koppel, Patrick, Heybl & Philpott

(57) ABSTRACT

Drum pedal assemblies are disclosed which can include one or more adjustment feature and/or interlocking feature. Adjustment features which can be included in embodiments of the invention can include spring tension adjustment features, pedal incline adjustment features, lever length adjustment features, and/or beater stem angle adjustment features. Drum pedal assemblies are also disclosed which can include slot-and-tab connections between assembly pieces, which can reduce or eliminate certain undesired pedal movements.

33 Claims, 8 Drawing Sheets

(56) References Cited

U.S. PATENT DOCUMENTS

| | | | | |
|---|---|---|---|---|
| 5,557,054 | A * | 9/1996 | Shigenaga | G10D 13/006 84/422.1 |
| 5,646,360 | A * | 7/1997 | Liao | G10D 13/006 84/422.1 |
| 6,166,312 | A | 12/2000 | Brewster | 84/422.1 |
| 6,271,450 | B1 | 8/2001 | Mackie | |
| 6,359,205 | B1 * | 3/2002 | Lombardi | G10D 13/006 84/422.1 |
| 6,570,076 | B1 * | 5/2003 | Kjellgren | G10D 13/006 84/422.1 |
| 6,573,443 | B1 * | 6/2003 | Chen | G10D 13/006 84/422.1 |
| 6,590,147 | B2 * | 7/2003 | Kassabian | G10D 13/006 84/422.1 |
| 6,689,945 | B1 * | 2/2004 | Matsuzoe | G10D 13/006 84/422.1 |
| 6,762,354 | B2 | 7/2004 | Cocca | |
| 6,822,149 | B1 * | 11/2004 | Liao | G10D 13/006 84/422.1 |
| 6,894,210 | B1 | 5/2005 | Lombardi | 84/422.1 |
| 6,903,257 | B2 | 6/2005 | Yun | 84/422.1 |
| 6,906,252 | B2 * | 6/2005 | Matsuzoe | G10D 13/065 84/422.1 |
| 6,992,244 | B2 * | 1/2006 | Paul | G10D 13/006 84/422.1 |
| 7,071,400 | B1 * | 7/2006 | Lombardi | G10D 13/06 84/402 |
| 7,197,957 | B2 | 4/2007 | Gatzen | 74/560 |
| 7,399,916 | B1 | 7/2008 | Lombardi | 84/422.1 |
| 7,449,626 | B2 | 11/2008 | Chen | 84/422.1 |
| 7,456,351 | B2 * | 11/2008 | Dorfman | G10D 13/006 84/422.1 |
| 7,579,540 | B2 | 8/2009 | Takegawa | 84/422.1 |
| 7,626,107 | B1 | 12/2009 | Takegawa | 84/422.1 |
| 7,671,262 | B1 | 3/2010 | Lin | 84/422.1 |
| 7,928,305 | B1 | 4/2011 | Chen | 84/422.1 |
| 7,956,268 | B1 | 6/2011 | Liao | |
| 7,968,781 | B1 | 6/2011 | Luo | 84/422.1 |
| 7,999,165 | B2 | 8/2011 | Chen | 84/422.1 |
| 8,063,293 | B1 | 11/2011 | Kjellgren | |
| 8,076,562 | B1 * | 12/2011 | Lin | G10D 13/006 84/422.1 |
| 8,278,541 | B2 * | 10/2012 | Dorfman | G10D 13/006 84/422.1 |
| 8,330,032 | B1 * | 12/2012 | Sikra | G10D 13/006 84/422.1 |
| 8,410,346 | B2 * | 4/2013 | Sassmannshausen | G10D 13/006 84/422.1 |
| 8,455,746 | B2 | 6/2013 | Johnston et al. | |
| 9,460,692 | B2 * | 10/2016 | Chen | G10D 13/006 |
| 9,472,174 | B2 * | 10/2016 | Sikra | G10D 13/006 |
| 2004/0060421 | A1 | 4/2004 | Yun | |
| 2005/0150354 | A1 * | 7/2005 | Paul | G10D 13/006 84/422.1 |
| 2007/0044637 | A1 * | 3/2007 | Kjellfren | G10D 13/006 84/422.1 |
| 2007/0113722 | A1 | 5/2007 | Chen | 84/422.1 |
| 2008/0196574 | A1 * | 8/2008 | Kjellgren | G10D 13/006 84/422.1 |
| 2011/0067552 | A1 * | 3/2011 | Chen | G10D 13/006 84/412 |
| 2012/0198984 | A1 | 8/2012 | Johnston | 84/422.1 |
| 2014/0182445 | A1 | 7/2014 | Liao | 84/422.1 |
| 2015/0082968 | A1 | 3/2015 | Sikra | 84/422.1 |
| 2015/0187343 | A1 * | 7/2015 | Mori | G10D 13/006 84/746 |
| 2016/0379609 | A1 * | 12/2016 | Sikra | G10D 13/006 84/422.1 |
| 2017/0278490 | A1 * | 9/2017 | Shigenaga | G10D 13/006 |

OTHER PUBLICATIONS

International Search Report and Written Opinion from patent appl. No. PCT/US17/13991, dated Apr. 6, 2017.
U.S. Appl. No. 14/506,350, filed Oct. 3, 2014, Sikra.
U.S. Appl. No. 13/663,655, filed Oct. 30, 2012, Sikra.
U.S. Appl. No. 61/882,530, filed Sep. 25, 2013, Sikra.
U.S. Appl. No. 61/899,862, filed Nov. 4, 2013, Sikra.
DWCP3500 "Hi-Hat Stand" from Drum Workshop. Inc. available online at www.dwdrums.com. downloade Feb. 3, 2015.
International Search Report and Written Opinion from Appl. No. PCT/US14/57383, dated Dec. 17, 2014.

* cited by examiner

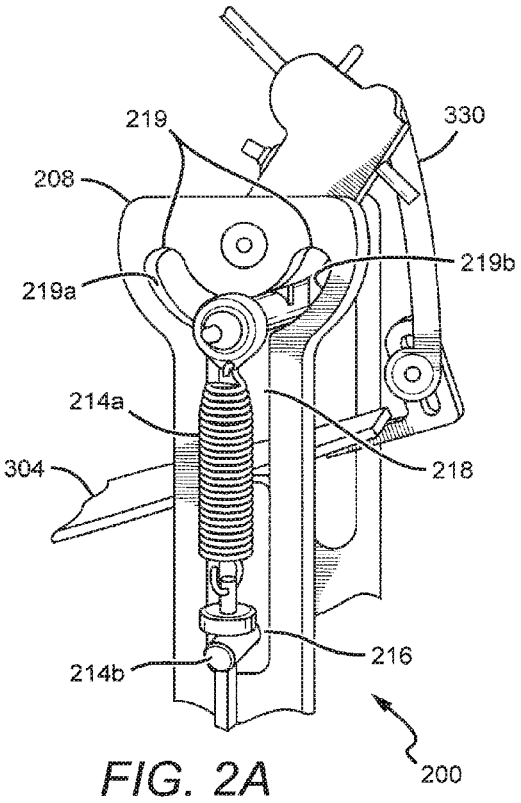
FIG. 2A
FIG. 2B
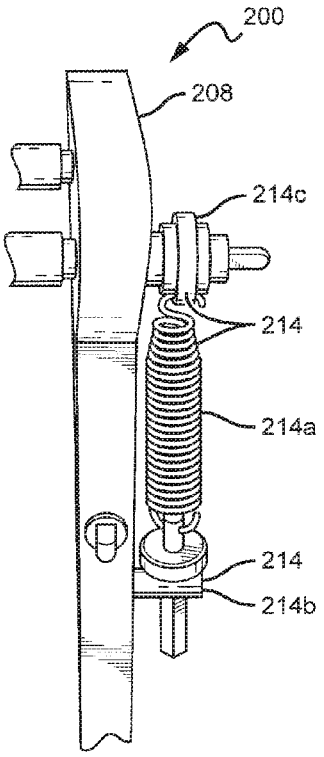
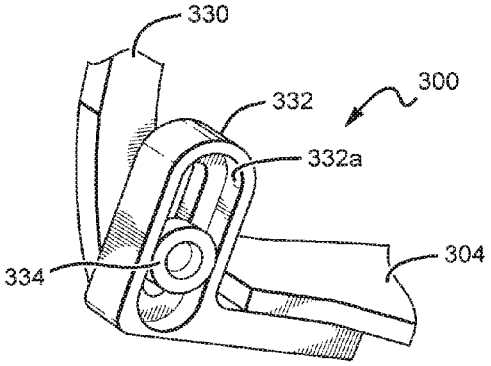
FIG. 3A
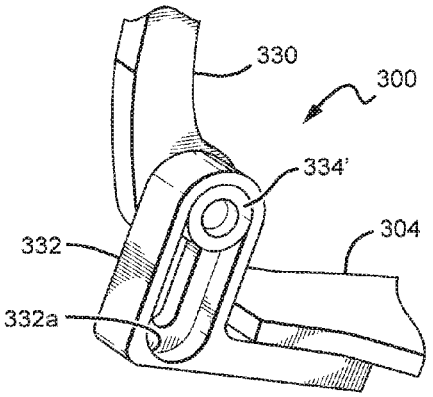
FIG. 3B

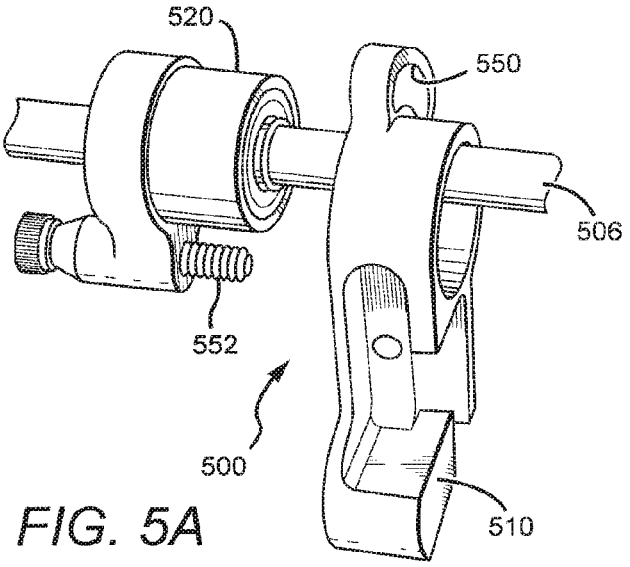
FIG. 5A
FIG. 5B
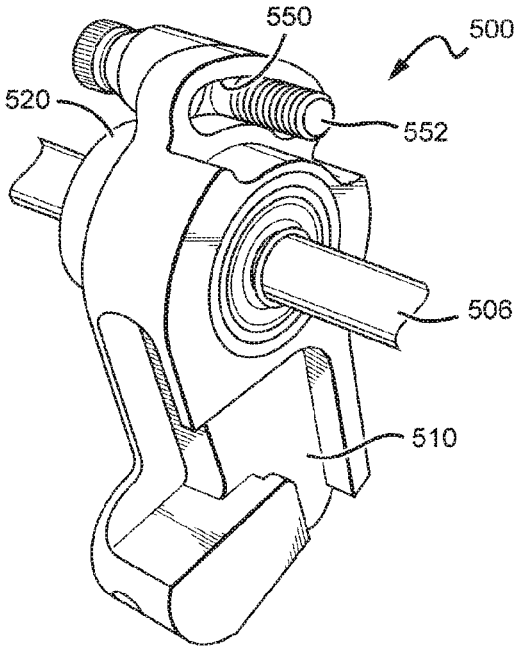
FIG. 5C
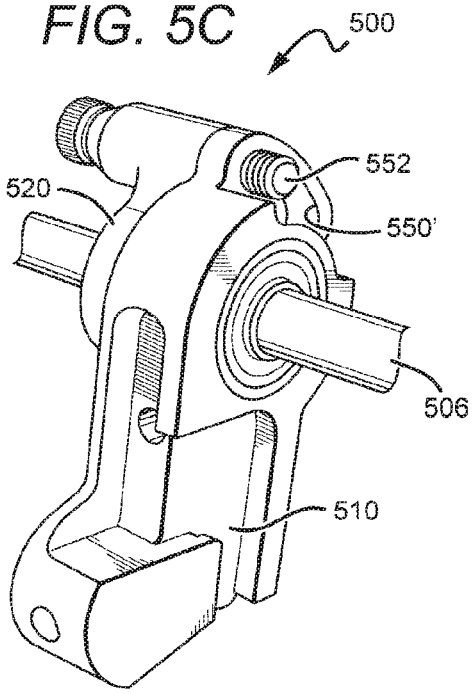

FIG. 7
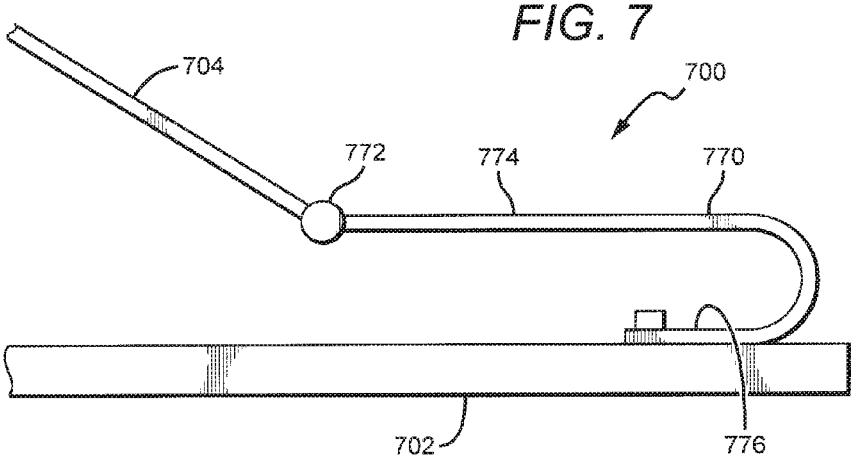
FIG. 8C
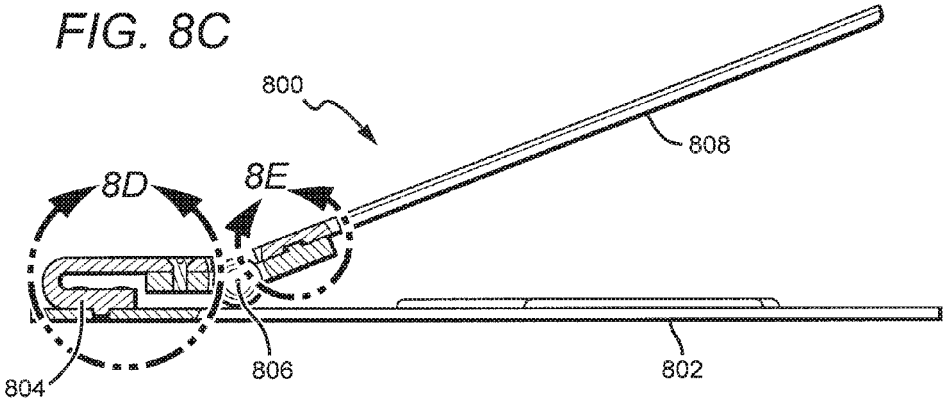
FIG. 8D
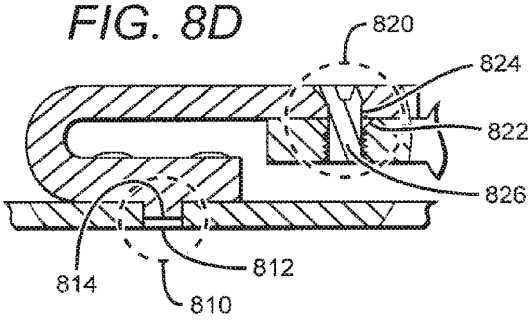
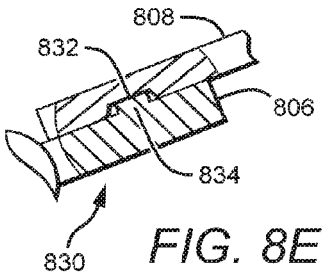
FIG. 8E

FIG. 8A
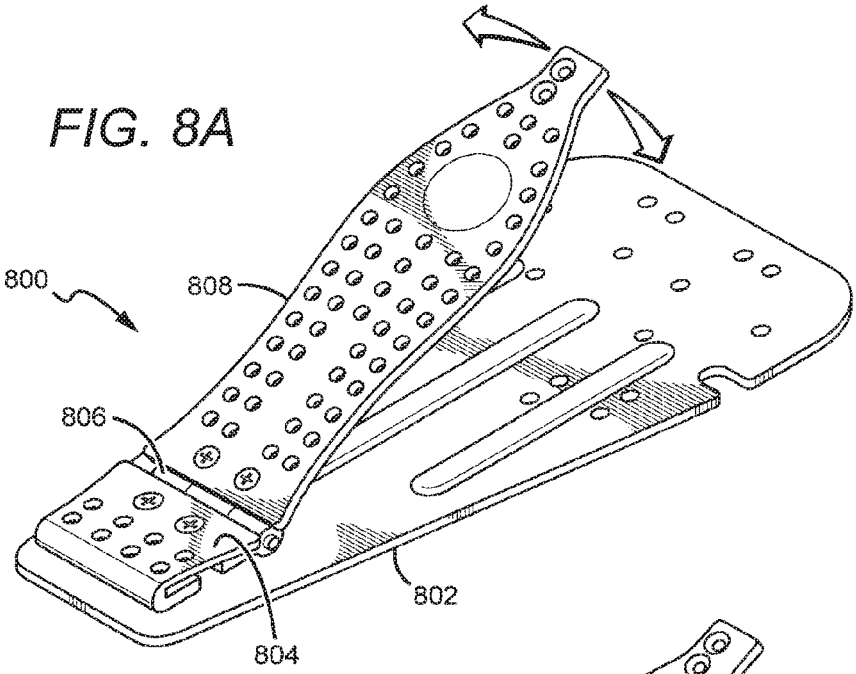
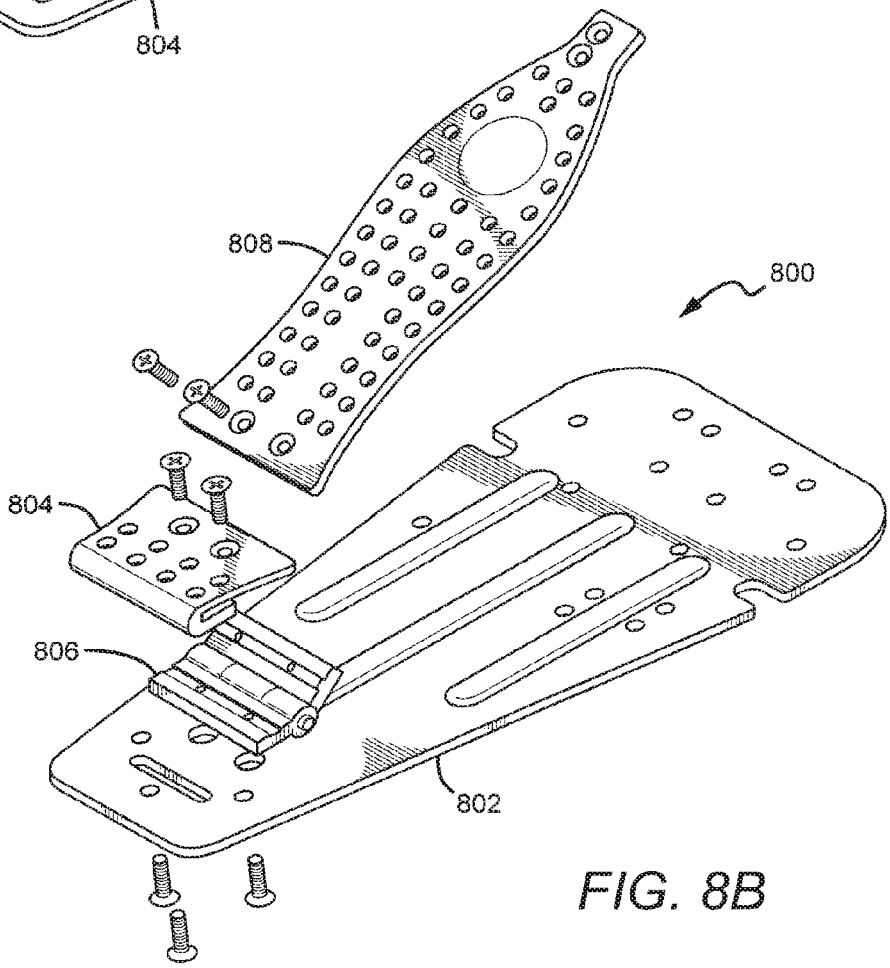
FIG. 8B

DRUM PEDAL WITH INTERLOCKING FEATURES

This application is a continuation of U.S. patent application Ser. No. 15/072,924 to Sikra, filed on Mar. 17, 2016, which is a divisional of U.S. patent application Ser. No. 14/495,718 to Sikra, filed on Sep. 24, 2014, which claims the benefit of U.S. Provisional Patent Application 61/899,762 to Sikra, filed on Nov. 4, 2013, and which claims the benefit of U.S. Provisional Patent Application 61/882,538 to Sikra, filed on Sep. 25, 2013. This application is also a divisional of U.S. patent application Ser. No. 14/495,718 to Sikra, filed on Sep. 24, 2014. Each of these four priority applications is fully incorporated by reference herein in its entirety.

BACKGROUND OF THE INVENTION

Field of the Invention

This invention relates generally to drum beating devices connectable to drums, such as bass drums, and more particularly to features such as adjustment features and interlocking features included in the devices.

Description of the Related Art

Drum pedal assemblies are used as a mechanism with which a drummer can strike a drum such as a bass drum, thus allowing the drummer's hands to be free for use with other drums. Variations in drummer technique mean that it is very difficult to design a single pedal to meet the needs of every drummer. Such variables can include drumming speed, foot force, and desired strike point.

Adjustable pedals can provide the customization necessary to achieve some or all of a drummer's desired pedal characteristics. Some pedals with adjustable features are described in U.S. Pat. Nos. 5,301,592 and 8,455,746 to Johnston, and U.S. Pat. No. 6,590,147 to Kassabian, each of which is fully incorporated by reference herein in its entirety. However, adjustment mechanisms provided in the prior art can be unwieldy, which can increase difficulty to the user, and/or can lack adjustability of a variable which is independent of other variables, thus reducing the amount of customization available via adjustments.

Prior art pedals also often use fasteners to connect different parts of a drum pedal assembly. However, due to normal wear and tear, a drum pedal assembly using fasteners such as screws as connection mechanisms can begin to experience unwanted movement during use. For example, a pedal can begin to experience lateral motion, when only upward and downward motion is desired.

BRIEF DESCRIPTION OF THE DRAWINGS

FIGS. 2A and 2B are side and rear views of a portion of another embodiment of a drum pedal assembly according to the present invention.

FIGS. 3A and 3B are side views of a portion of another embodiment of a drum pedal assembly according to the present invention.

FIGS. 5A-5C are perspective views of a portion of another embodiment of a drum pedal assembly according to the present invention.

FIG. 7 is a side view of a portion of another embodiment of a drum pedal assembly according to the present invention.

FIGS. 8A-8E are perspective, exploded perspective, side, and two magnified side views of another embodiment of a portion of a drum pedal assembly according to the present invention.

DETAILED DESCRIPTION OF THE INVENTION

The present invention relates to a drum beating device such as a pedal device for use with a bass drum. The drum beating device can include adjustment features to change 1) the tension of a spring within the device, 2) the inclination angle of the pedal, 3) the distance between a beater stem and axle, and/or 4) the angle the lever forms with the axle when in a rest position. The drum beating device can also include a flexible heel plate attached to a base and/or pedal. The drum beating device can also include interconnection features such as tab/slot combinations for connecting two or more parts of the device. These tab/slot combinations can reduce or eliminate undesired movements.

It is understood that when an element is referred to as being "on" another element, it can be directly on the other element or intervening elements may also be present. Further, when one element is referred to as being "connected" to another element, it can be directly connected to the other element or intervening elements may also be present as would be understood by one of skill in the art. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

Embodiments of the invention are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the invention.

Figure 1A:
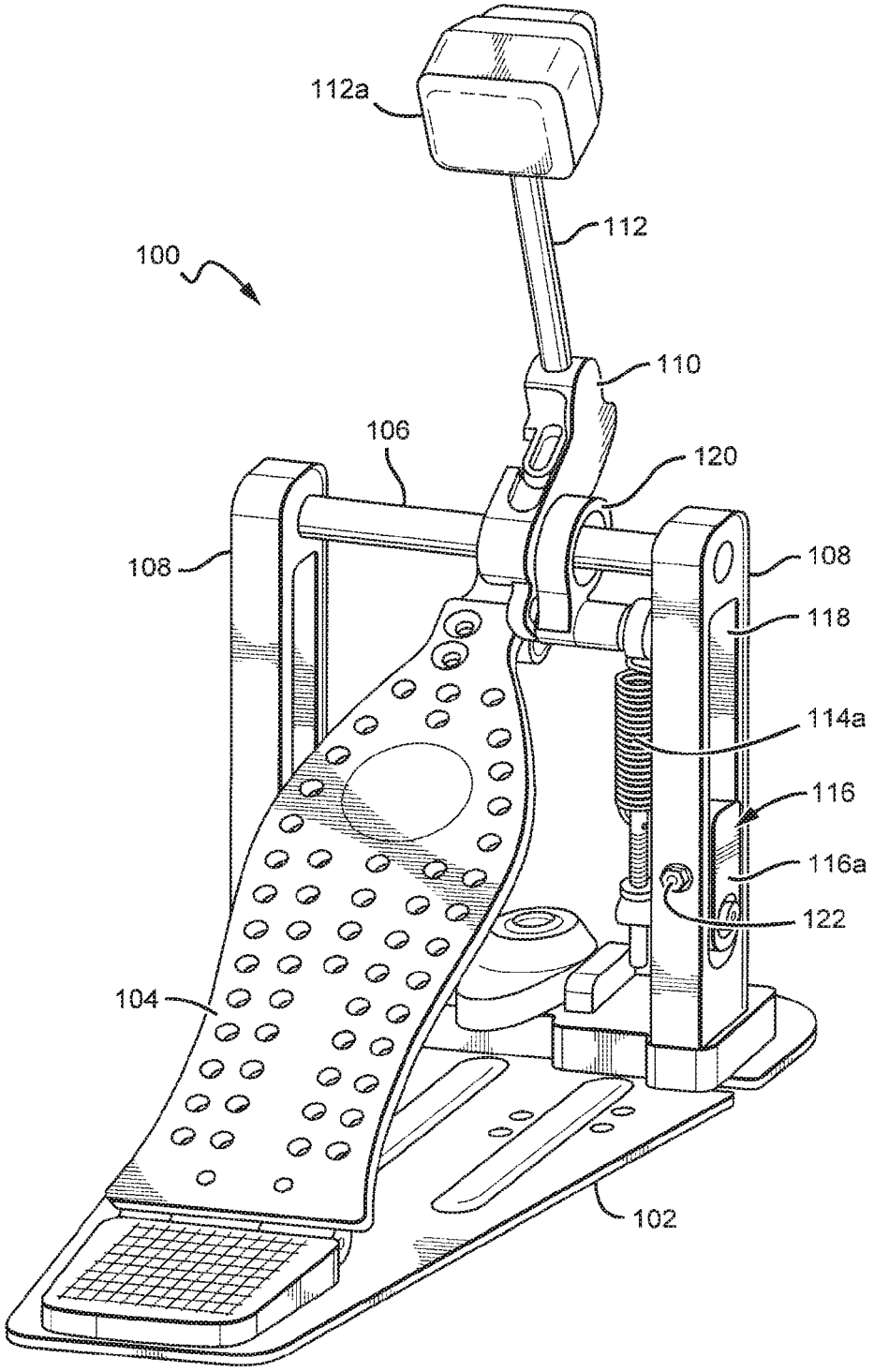
FIGS. 1A and 1B are perspective views of one embodiment of a drum pedal assembly according to the present invention.
Figure 1B:
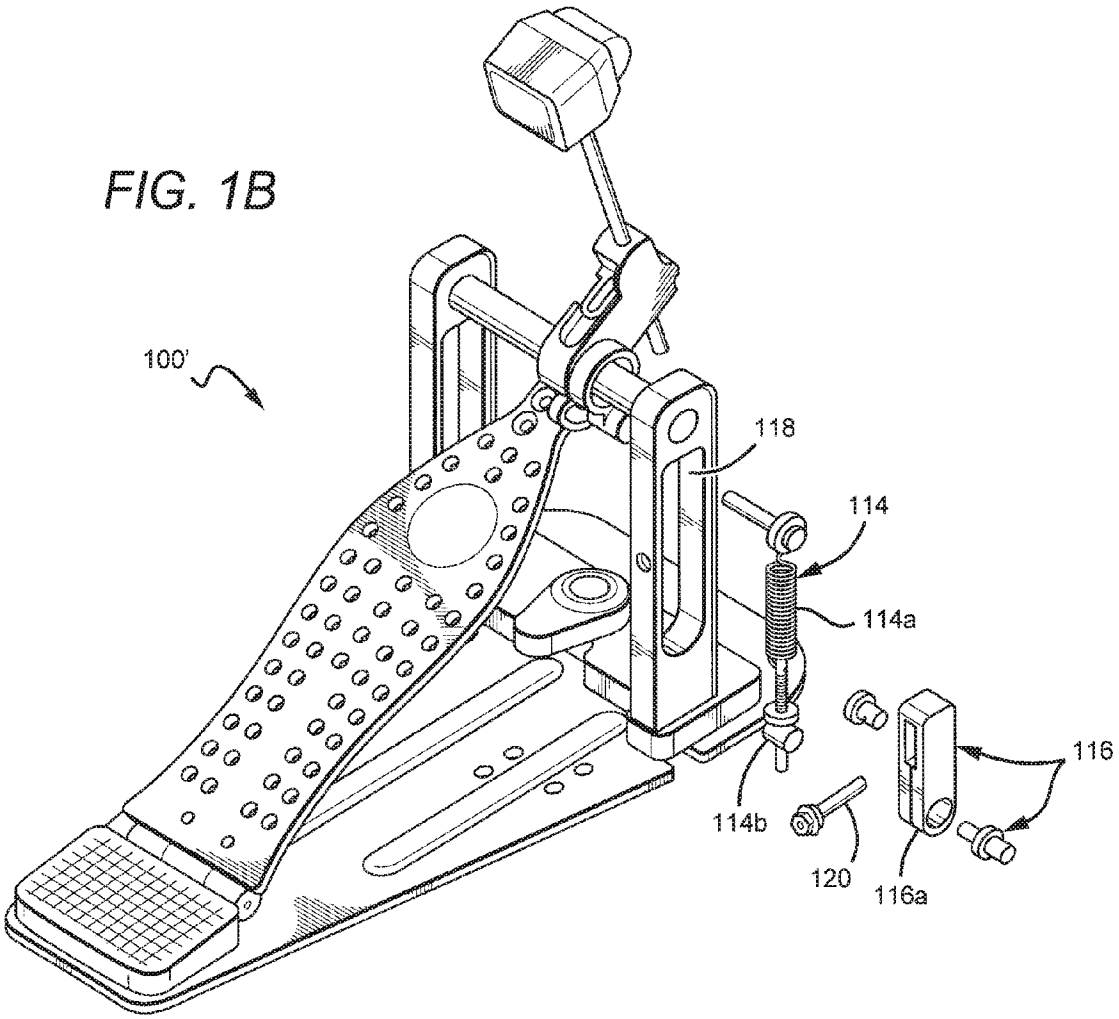

FIG. 1A shows one embodiment of a drum pedal 100 according to the present invention, with FIG. 1B showing the drum pedal 100' partially disassembled. The drum pedal 100 can include a base 102, a pedal 104, and an axle 106.

The axle 106 can be mounted on one or more upright pedestals 108 (in this case two pedestals) which can be vertical or nonvertical. A lever member 110 can be rotatably attached to the axle 112. A drum beater stem 112 and beater 112*a* can be attached to the lever member 110, although in an alternate embodiment the beater stem 112 can be attached to the axle 106 without the presence of a lever member. The drum pedal 100 can include many other components, such as a clamp system for attachment to a bass drum, for example. Some appropriate clamping systems are discussed in commonly assigned U.S. patent application Ser. No. 13/663,655 to Sikra and entitled "Pivot Supports for Drum Rims", which is fully incorporated by reference herein in its entirety.

A spring assembly 114 can be used to return the drum pedal 100 to its resting position automatically after the pedal 104 has been actuated. The spring system 114 can include, for example, a spring mechanism 114*a* and a pivot 114*b*. The spring assembly 114 can be connected to a hub 120. The hub 120 can be connected to the beater stem 112, such as connected through the lever member 110. The hub 120 can connect the spring assembly 114 to other moving parts of the drum pedal 100, such as the lever member 110, beater stem 112, and pedal 104. During actuation of the pedal 104, the hub 120 can rotate in one direction about the axle 106, causing the tension in the spring mechanism 114*a* to increase. When actuation of the pedal 104 is complete, the tension in the spring mechanism 114*a* can cause the hub 120, and thus the other moving parts of the drum pedal 100, to return to their resting positions. Additionally, the amount of tension in the spring 114*a* while the drum pedal 100 is in a resting position can determine the amount of resistance a user encounters when actuating the pedal. The hub 120 and axle 106 can be rotatably linked, or can rotate independently of one another. Alternatively the axle 106 can be static and not rotate.

The pedal 100 can also include a spring tensioning assembly 116. The spring tensioning assembly can include one or more of, for example, springs, screws, bearings such as but not limited to threaded swivel bearings shown in U.S. Pat. App. Nos. 61/882,538 and 61/899,762 to Sikra, and/or many other features. The tensioning assembly 116 can be included in an aperture 118 within one of the pedestals 108, although other embodiments are possible. The tension housing 116*a* can be connected to spring assembly 114 and/or the spring mechanism 114*a*, such as through the pivot 114*b*, although other embodiments are possible. The tension housing 116*a* can be adjustable, such as vertically adjustable. Because the tension housing 116*a* can be connected to the bottom of the spring mechanism 114*a* (such as through the pivot 114*b*), moving the tension housing 116*a*up or down can change the tension provided by the spring mechanism 114*a*. For instance, moving the tension housing 116*a* up can reduce the tension in the spring mechanism 114*a*, such as by moving the pivot 114*b* up such that the mechanism 114*a* is more compact. Moving the tension housing 116*a* down can increase the tension in the spring mechanism 114*a*, such as by moving the pivot 114*b* down such that the mechanism 114*a* stretches.

The tensioning assembly 116 (and thus the spring assembly 114) can be adjusted in a number of manners. In one manner, the tension housing 116*a* can be moved by adjusting a rotatable member 122. The rotatable member 122 can be threaded, such as a screw, and/or can be adjustable using common tools in the art, such as a drum key. The rotatable member can be accessible from the outside of the pedestal 108, or can be elsewhere. Other embodiments, such as a pin method to lock the housing 116*a* into place, can also be used.

The tensioning assembly 116 can be adjustable by a user to better suit a user's needs or preferences in multiple areas. For instance, the tensioning assembly 116 can be adjusted to increase or decrease pedal resistance, and/or can be adjusted to increase or decrease the velocity with which the pedal 104 and other components return to resting position after an actuation.

FIGS. 1A and 1B show a drum pedal 100 including a spring assembly 114 between two pedestals 108, which can allow the drum pedal 100 to be more compact. However, in other embodiments a spring assembly may be outside the pedestals. This can decrease the likelihood of a drummer's foot accidentally contacting the spring assembly. FIGS. 2A and 2B show magnified side and rear views of a portion of a drum pedal 200 comprising a spring assembly 214 outside the pedestals 208. The drum pedal 200 can include a tensioning assembly 216 that can operate in a manner similar to or the same as the tensioning assembly 116 from FIGS. 1A and 1B.

Also shown in FIG. 2 are a link member 330 which can connect a pedal 304 to the remainder of the assembly. While the link member 330 and other link members shown herein are shown as rigid, thus forming "direct drive" pedals, it is understood that any type of link member can be used as is known in the art, including but not limited to chains, ropes, and/or straps. The pedal 304 and link member 330 will be discussed in detail below with regard to FIG. 3.

The spring assembly 214 can include a spring 214*a* and a pivot 214*b*, and the pedestal 208 can be shaped to define an aperture 218 similar to the aperture 118 from FIGS. 1A and 1B. The pedestal 208 can be shaped to define a second aperture 219, which can be connected to or separated from the first aperture 218 (in the case shown, the apertures are connected to one another to form one large aperture). Upon actuation of a pedal 304, the top 214*c* of the spring assembly 214 can be caused to rotate about the axle of the drum pedal 200. In this case, the top 214*c* of the spring assembly 214 would be caused to move up and to the left within the aperture portion 219*a*, as shown in FIG. 2A. Upon completion of the actuation, the spring assembly 214 will recoil such that the top 214*c* may actually pass its resting point and enter into the second portion 219*b* of the aperture 219. The presence of the second portion 219*b* of the aperture 219 can allow the drum pedal 200 to return to a resting position in a much more natural and fluid swinging motion, as opposed to reaching an abrupt halt if there were no aperture portion 219*b*, which can be undesirable.

FIGS. 3A and 3B show a pedal 300 which can include a pedal incline adjustment feature. In the embodiment shown, the pedal 304 can include a pedal attachment mechanism 332 which can be used to connect the pedal 304 to a link member 330. In the specific embodiment shown the pedal attachment mechanism 332 defines an aperture 332*a*, and the link member 330 can include a pin 334 which can act as the male piece when connecting to the attachment mechanism 332. The pin 334 can be locked into place within the aperture 332*a* using, for instance, a drum key or other screw mechanism, although many different embodiments are possible. Many other embodiments are possible, and either of the pedal 304 or the link member 330 can include male or female pieces.

The pedal incline adjustment feature can operate so as to make adjustable the angle of incline of the pedal 304. For instance, in FIG. 3A, the pin 334 is lower in the aperture 332*a*, meaning that the pedal 304 is at a lower angle of incline. In FIG. 3B, the pin 334' is locked into position higher in the aperture 332*a*, meaning that the pedal 304 is at a steeper angle of incline. The angle can be adjusted to fit a user's needs and preferences. Further, this adjustment can be made independent of other pedal features. For instance, in some prior art pedal assemblies, the pedal incline can be adjusted, but only if another feature (such as the location of the link member 330) is also altered. The pedal incline adjustment feature according to the present invention allows for much greater customization of the drum pedal assembly.

Figure 4A:
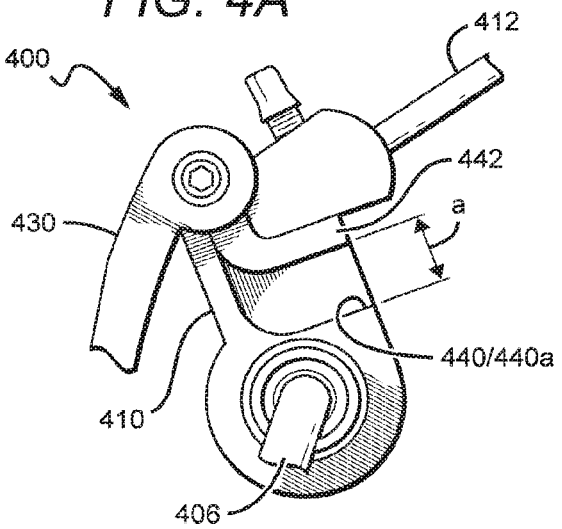
FIGS. 4A-4C are side views of a portion of another embodiment of a drum pedal assembly according to the present invention.
Figure 4B:
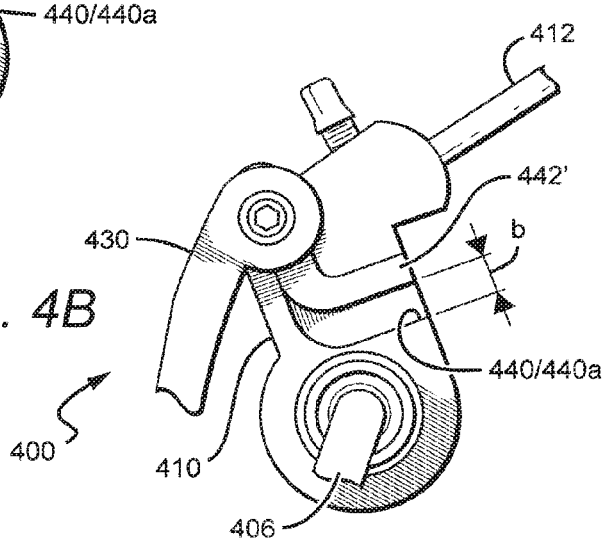
Figure 4C:
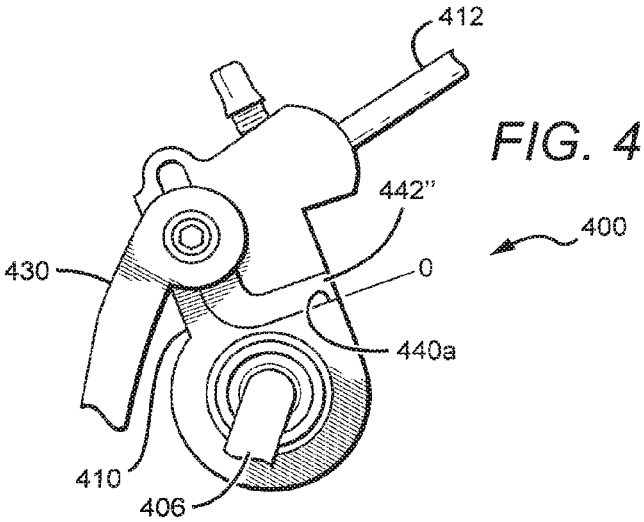

FIGS. 4A-4C show a drum pedal assembly 400 that can include a lever length adjustment feature. The assembly 400 can include a lever 410 similar to or the same as the lever 110 from FIGS. 1A and 1B, for instance. The assembly can also include an axle 406, a beater stem 412, and a link member 430. In many embodiments, the link member 430 can form a junction with the base of the beater stem 412 at or near the end of the lever 410. The length of the lever 410, or the distance between the axle 406 and the base of the beater stem 412, can have an effect on the velocity, force, path of motion, and/or other characteristics of the motion of the beater (not shown). For instance, typically a greater distance between the axle 406 and the beater stem 412, the greater the velocity and force with which the beater moves toward a drum head.

In the embodiment shown in FIGS. 4A-4C, the drum pedal assembly 400 can include a feature that allows the junction point between 1) the link member 430 and the base of the beater stem 412, and 2) the lever 410 to be adjustable. In the specific embodiment shown, the lever 410 can include a channel 440 while the link member 430 can include an adjustment member 442. When unlocked, the adjustment member 442 can slide to different locations within the channel 440, and then be locked into place, such as with a drum key or screwdriver. For instance, FIG. 4A shows an embodiment where the adjustment member 442 is within the channel 440 at a distance "a" from the inner edge 440*a* of the channel 440. In FIG. 4B, the adjustment member 442' is closer to the inner edge 440*a*, at a distance "b" from the inner edge 440*a*. In FIG. 4C, the adjustment member 442" abuts the inner edge 440*a* to minimize the distance between the base of the beater stem 412 and the axle 406.

FIGS. 5A-5C show a drum pedal assembly 500 that can include a lever angle adjustment feature. This feature can adjust the resting angle a lever 510 forms with the axle 506. In the embodiment shown, the assembly 500 can include a hub 520 which can act to connect a spring mechanism to a lever 510. In the embodiment shown, the connection between the lever 510 and the hub 520 can be made to be adjustable, with the resting orientation of the hub 520 staying relatively constant and the orientation of the lever 510 being adjusted, although other embodiments are possible. The lever 510 can include a channel and/or aperture 550, while the hub 520 can include a pin 552 or similar male part, although either of the lever 510 and hub 520 can include a male and/or female member. When unlocked, the lever 510 can be rotated about the axle 506 independent of the hub 520 and pin 552, thus adjusting the connection between the lever 510 and hub 520. For instance, in FIG. 5B the pin 552 is shown in a first position within the channel 550 such that the lever 510 is at a more downward angle. In FIG. 5C, the pin 552 is shown in a second position within the channel 550' such that the lever 510 is at a higher angle. The arrangement shown in FIG. 5B will cause a beater to impact a drum head sooner in the assembly's motion, since the lever 510, and thus the beater, begin their motion closer to the drum head, while in FIG. 5C the beater will be in a more rearward position.

Figure 6A:
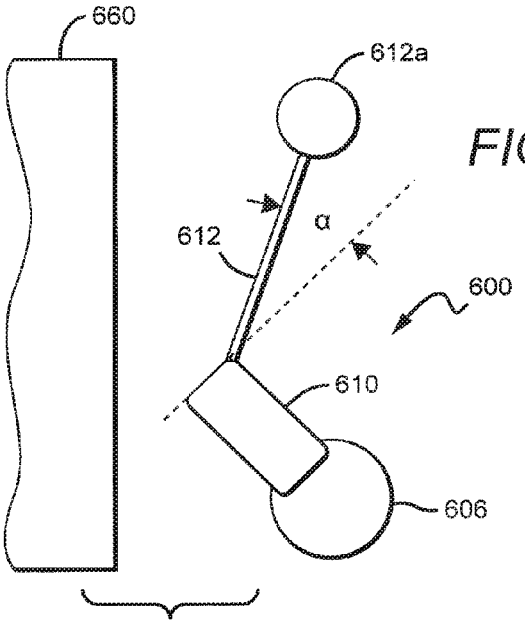
FIGS. 6A-6C are side views of a drum pedal assembly and bass drum head according to one embodiment of the present invention.
Figure 6B:
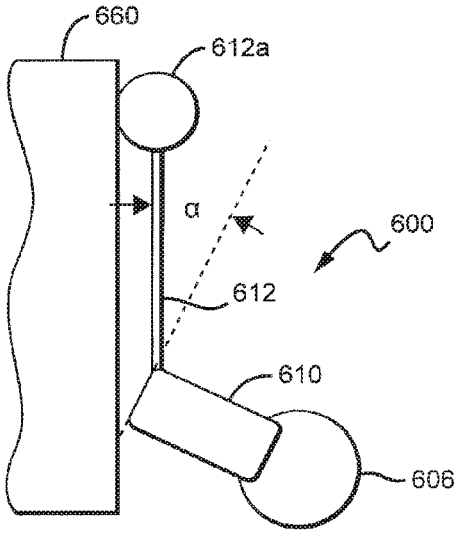
Figure 6C:
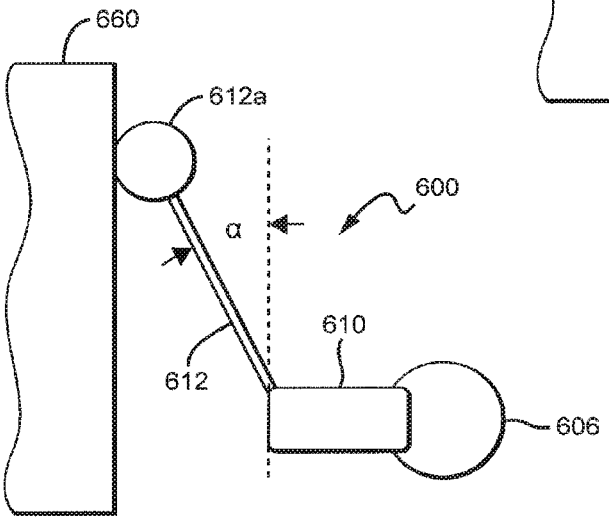

Typically, it is desirable to design a pedal assembly such that a beater impacts a drum head when the beater's motion is approximately perpendicular to the drum head and/or when the beater stem is approximately parallel to the drum head. FIGS. 6A-6C show schematics of manners in which this goal can be achieved. A drum pedal assembly 600 can include an axle 606, lever 610, beater stem 612, and beater 612*a*. The beater stem can be non-perpendicular to the lever 610, and in this embodiment is slightly forward of perpendicular by an angle $\alpha$. The forward angle can be 0° to 25°, 10° to 16°, and/or about 13°. Given such an angle, if properly arranged the lever 610 can be short of horizontal upon impact, if impact is made with the beater 612*a* travelling perpendicular to a drum head 660 (as shown in FIG. 6B). Alternatively, the lever 610 can be slightly short of horizontal, horizontal (as shown in FIG. 6C), or slightly forward of horizontal upon impact. Users have found that when a lever goes past horizontal or more than slightly past horizontal, performance can be diminished. As such, if a lever angle adjustment feature such as that shown in FIGS. 5A-5C is utilized, the feature (e.g., the channel and/or pin) can be designed such that a lever cannot pass 10° past horizontal, cannot pass 5° past horizontal, or cannot go past horizontal.

FIG. 7 shows a drum pedal assembly 700 according to the present invention which can include a flexible heel plate 770. The heel plate 770 can be attached to a base 702 and/or a hinge 772, which can itself be attached to a pedal 704. The flexible heel plate 770 can be made of, for example, metal. The heel plate 770 can be in a J-shape of a U-shape, such that in one embodiment the top 774 of the heel plate is separated from the bottom 776 of the heel plate. In the J-shape embodiment shown, the shorter end of the "J" can be attached to the base 702 while the longer end is attached to the hinge 772. This can allow the top 774 of the heel plate 770 to flex downward upon a force applied by a user of the assembly 700.

Drum pedal assemblies according to the present invention can also include interlocking features, such as interlocking features connecting a base to a heel plate, a heel plate to a hinge assembly, and/or a hinge assembly to a pedal, for example. One such drum pedal assembly 800 is shown in FIGS. 8A-8E. In many prior art pedal assemblies using conventional screw connections or other prior art connections, some elements can begin to experience undesirable movement, such as due to wear and tear. For example, the arrows in FIG. 8A show a type of undesirable lateral motion that can be experienced in many prior art assemblies. Further, undesired motion can also cause other problems such as hinge lock-up due to bending of parts. The assembly 800 can include interlocking features which can reduce or eliminate these problems.

In the specific embodiment shown, the assembly 800 includes three sets of interlocking features, although more are less are possible. Further, the assembly uses both interlocking features and screw connections, although the use of interlocking features without screw connections is possible, such as the use of interlocking features with an adhesive. Further, while each interlocking feature includes a first piece with a male part and a second piece with a female part, it us understood that different male/female combinations are possible.

The assembly 800 can include a base 802, a heel plate 804, a hinge piece 806, and a pedal 808. The heel plate 804 can be a flexible heel plate similar to that described above with regard to FIG. 7. A first interlocking mechanism 810 is best shown in FIGS. 8B and 8D. The mechanism 810 can include parts of the base 802 and the heel plate 804. In the specific embodiment shown, the base 802 can include a slot 812, while the heel plate 804 can include a tab 814. While the slot 812 and tab 814 are shown as linear, it is understood that interlocking mechanisms according to the present invention can use many different shapes, including but not limited to zig-zag shapes, X-shapes, triangular shapes, and/or other polygon shapes, for example. Further, multiple interlocking systems can be used in conjunction with one another to connect two pieces, such as a base and heel plate.

In the interlocking system 810, the slot 812 can be a slot without a bottom surface, although in other embodiments a bottom surface may be present. Further, the slot 812 can include side surfaces to prevent lateral movement (as opposed to a slot running the entire width of the base 802). The tab 814 can fit within the slot 812 as shown in FIG. 8D.

The assembly 800 can also include an interlocking system 820, which can connect the heel plate 804 to the hinge piece 806. In this instance, the heel plate 804 can include a tab 824 while the hinge piece 806 can include a slot 822. The slot 822 is shown as including a bottom surface and running the entire width of the hinge piece 806, although in other embodiments it includes side surfaces instead of running the entire width, which can reduce or eliminate types of unwanted motion such as lateral and/or non-rotational lateral motion, for example. In the embodiment shown, fasteners 826 such as screws can be placed through both the tab 824 and the slot 822, although these screws may not be present or may be placed elsewhere.

The assembly 800 can also include interlocking system 830, which can connect the hinge piece 806 to the pedal 808. The interlocking system 830 is best shown in FIGS. 8B and 8E. The system 830 is similar in many respects to the system 820, and includes a slot 832 and tab 834 that run the entire width of their respective pieces, although embodiments including side walls are possible. As shown in FIG. 8E, the slot 832 and tab 834 have trapezoidal cross-sections, but many different cross-sections are possible, including but not limited to rectangular.

Although the present invention has been described in detail with reference to certain preferred configurations thereof, other versions are possible. Therefore, the spirit and scope of the invention should not be limited to the versions described above.

I claim:

1. A drum pedal assembly, comprising:
a heel plate;
a pedal; and
a hinge piece connecting said heel plate and said pedal;
wherein said hinge piece comprises a first slot or a first tab; and
wherein said heel plate or said pedal comprises the other of said first slot and said first tab, said first tab for fitting into said first slot.

2. The drum pedal assembly of claim 1, wherein said first tab is within said first slot.

3. The drum pedal assembly of claim 2, wherein said heel plate is a J-shaped or U-shaped flexible heel plate.

4. The drum pedal assembly of claim 2, wherein said heel plate comprises the other of said first slot and said first tab.

5. The drum pedal assembly of claim 4, wherein said hinge piece comprises one of a second slot and a second tab, and wherein said pedal comprises the other of said second slot and said second tab, said second slot within said second tab.

6. The drum pedal assembly of claim 2, wherein said pedal comprises the other of said first slot and said first tab.

7. The drum pedal assembly of claim 2, further comprising a fastener through said first tab and said first slot.

8. The drum pedal assembly of claim 4, wherein said heel plate is a J-shaped or U-shaped flexible heel plate.

9. A drum pedal assembly, comprising:
a base;
a heel plate adjacent said base;
a hinge piece adjacent said heel plate; and
a pedal adjacent said hinge piece;
wherein one of said base, heel plate, hinge piece, and pedal comprises a female part; and
wherein another of said base, heel plate, hinge piece, and pedal comprises a male part for fitting into said female part.

10. The drum pedal assembly of claim 9, wherein said male part is snapped into said female part.

11. The drum pedal assembly of claim 10, wherein said hinge piece comprises one of said female part and said male part; and
wherein said heel plate comprises the other of said female part and said male part.

12. The drum pedal assembly of claim 11, wherein said male part is a first male part and said female part is a first female part;
wherein said hinge piece comprises one of a second male part and a second female part; and
wherein said pedal comprises the other of said second male part and said second female part, said second male part snapped into said second female part.

13. A drum pedal assembly, comprising:
a base; and
a heel plate on said base;
wherein one of said base and said heel plate comprises an indentation;
wherein the other of said base and said heel plate comprises a protrusion for fitting into said indentation; and
wherein said heel plate is a J-shaped or U-shaped flexible heel plate.

14. The drum pedal assembly of claim 13, wherein said protrusion is within said indentation.

15. The drum pedal assembly of claim 14, wherein said indentation is a slot and said protrusion is a tab.

16. The drum pedal assembly of claim 15, wherein said base comprises said tab and said heel plate comprises said slot.

17. The drum pedal assembly of claim 15, wherein said heel plate comprises said tab and said base comprises said slot.

18. The drum pedal assembly of claim 14, wherein said heel plate is a J-shaped flexible heel plate.

19. The drum pedal assembly of claim 14, wherein said heel plate is a U-shaped flexible heel plate.

20. The drum pedal assembly of claim 14, further comprising a hinge piece, said hinge piece comprising a first leaf connected to said heel plate and a second leaf configured for connection to a pedal.

21. The drum pedal assembly of claim 20, wherein said protrusion is a first protrusion and said indentation is a first indentation;
wherein said first leaf comprises one of a second protrusion and a second indentation, and said heel plate comprises the other of said second protrusion and said second indentation; and
wherein said second protrusion is within said second indentation.

22. The drum pedal assembly of claim 21, wherein each of said first protrusion and said second protrusion is a tab, and each of said first indentation and said second indentation is a slot.

23. A heel plate for use as part of a drum pedal assembly, wherein said heel plate is a J-shaped or U-shaped flexible heel plate and comprises:

a bottom portion for connection to a base plate, said bottom portion comprising a bottom portion bottom surface;

a top portion for connection to a hinge piece leaf, said top portion comprising a top portion bottom surface; and a curved portion connecting said bottom portion and said top portion;

wherein:

said bottom portion comprises a first protrusion for mating with a base plate indentation, or a first indentation for mating with a base plate protrusion, said first protrusion or first indentation on said bottom portion bottom surface; or said top portion comprises a first protrusion for mating with a hinge piece indentation, or a first indentation for mating with a hinge piece protrusion, said first protrusion or first indentation on said top portion bottom surface.

24. The heel plate of claim 23, wherein said bottom portion comprises a first protrusion for mating with a base plate indentation, or a first indentation for mating with a base plate protrusion, said first protrusion or first indentation on said bottom portion bottom surface.

25. The heel plate of claim 24, wherein said bottom portion comprises a first protrusion for mating with a base plate indentation, said first protrusion on said bottom portion bottom surface.

26. The heel plate of claim 24, wherein said bottom portion comprises a first indentation for mating with a base plate protrusion, said first indentation on said bottom portion bottom surface.

27. The heel plate of claim 23, wherein said top portion comprises a first protrusion for mating with a hinge piece indentation, or a first indentation for mating with a hinge piece protrusion, said first protrusion or first indentation on said top portion bottom surface.

28. The heel plate of claim 27, wherein said top portion comprises a first protrusion for mating with a hinge piece indentation, said first protrusion on said top portion bottom surface.

29. The heel plate of claim 27, wherein said top portion comprises a first indentation for mating with a hinge piece protrusion, said first indentation on said top portion bottom surface.

30. The heel plate of claim 23, wherein said first protrusion or first indentation is a first tab or a first slot, respectively.

31. The heel plate of claim 23, wherein said bottom portion comprises a first protrusion for mating with a base plate indentation, or a first indentation for mating with a base plate protrusion, said first protrusion or first indentation on said bottom portion bottom surface; and wherein said top portion comprises a second protrusion for mating with a hinge piece indentation, or a second indentation for mating with a hinge piece protrusion, said second protrusion or second indentation on said top portion bottom surface.

32. The heel plate of claim 23, wherein said heel plate is a J-shaped flexible heel plate.

33. The heel plate of claim 23, wherein said heel plate is a U-shaped flexible heel plate.

* * * * *